US006938899B2

(12) United States Patent
Kenney et al.

(10) Patent No.: US 6,938,899 B2
(45) Date of Patent: Sep. 6, 2005

(54) TILE-BASED BOARD GAME

(75) Inventors: Tyler Kenney, Hawthorne, CA (US); Tadd Callies, La Crescenta, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/286,399

(22) Filed: Nov. 1, 2002

(65) Prior Publication Data

US 2003/0127800 A1 Jul. 10, 2003

Related U.S. Application Data

(60) Provisional application No. 60/340,030, filed on Nov. 1, 2001.

(51) Int. Cl.[7] ..... A63F 1/00

(52) U.S. Cl. ..... 273/292; 273/146; 273/236

(58) Field of Search ..... 273/292, 146, 273/236

(56) References Cited

U.S. PATENT DOCUMENTS

| | | | | | |
|---|---|---|---|---|---|
| 3,565,438 | A | * | 2/1971 | Bischof | 273/253 |
| 4,089,527 | A | * | 5/1978 | Roth | 273/249 |
| 4,309,036 | A | * | 1/1982 | Alvey | 273/248 |
| 4,331,333 | A | | 5/1982 | Willcocks | |
| 4,341,387 | A | | 7/1982 | Freyman | |
| 4,659,085 | A | * | 4/1987 | DeVries | 273/236 |
| 4,743,031 | A | * | 5/1988 | Lamle | 273/146 |
| 4,783,080 | A | * | 11/1988 | Rosenwinkel et al. | 273/255 |
| 4,844,473 | A | * | 7/1989 | Landsberg | 273/264 |
| 4,984,807 | A | * | 1/1991 | Shiryon | 273/263 |
| 5,020,805 | A | * | 6/1991 | Fratangelo et al. | 273/255 |
| 5,026,070 | A | * | 6/1991 | Watt | 273/261 |
| 5,125,660 | A | * | 6/1992 | Stahl | 273/146 |
| 5,301,952 | A | * | 4/1994 | Fitzgerald | 273/269 |
| 5,312,112 | A | * | 5/1994 | Cohen | 273/272 |
| 5,388,830 | A | * | 2/1995 | Dixson | 273/146 |
| 5,388,837 | A | * | 2/1995 | Hoffman | 273/262 |
| 5,476,264 | A | * | 12/1995 | Ortega | 273/255 |
| 5,516,114 | A | * | 5/1996 | Michlin et al. | 273/400 |
| 5,570,887 | A | * | 11/1996 | Christie, Jr. | 273/261 |
| 5,607,159 | A | | 3/1997 | Bryson | |
| 5,609,339 | A | * | 3/1997 | Mahoney | 273/255 |
| 5,688,126 | A | * | 11/1997 | Merritt | 434/128 |
| 5,820,126 | A | * | 10/1998 | Moore | 273/253 |
| 6,182,967 | B1 | * | 2/2001 | Green | 273/290 |
| 6,209,873 | B1 | * | 4/2001 | DeGeorge | 273/262 |
| 6,267,378 | B1 | * | 7/2001 | Kanbar | 273/342 |
| 6,305,688 | B1 | * | 10/2001 | Waroway | 273/292 |
| 6,561,513 | B1 | * | 5/2003 | DeGeorge | 273/262 |
| 2003/0034606 | A1 | * | 2/2003 | Jacobs | 273/236 |
| 2003/0085515 | A1 | * | 5/2003 | Yu et al. | |
| 2003/0085520 | A1 | * | 5/2003 | Bedfore et al. | |
| 2003/0094758 | A1 | * | 5/2003 | Hardie et al. | 273/243 |
| 2003/0132575 | A1 | * | 7/2003 | Hallett | |

* cited by examiner

*Primary Examiner*—Gregory Vidovich
*Assistant Examiner*—Dolores R. Collins
(74) *Attorney, Agent, or Firm*—Kolisch Hartwell, PC

(57) ABSTRACT

A board game including game pieces and rules for playing a game for a plurality of players, the goal of which is to defeat an opponent through battle of game pieces. The invention provides a board, multiple tile-like pieces, and at least one die. The tile-like pieces are used to block or challenge an opponent through the use of indicia on the outer periphery of each piece. Several levels of play are provided through the use of several game piece sets, which may be obtained independently.

7 Claims, 3 Drawing Sheets

TILE-BASED BOARD GAME

CROSS-REFERENCE TO RELATED APPLICATIONS

This application is based upon and claims priority under 35 U.S.C. § 119(e) to the following U.S. provisional patent application, which is incorporated herein by reference in its entirety for all purposes: Ser. No. 60/340,030, entitled "Tile-Based Board Game," filed Nov. 1, 2001.

FIELD OF THE INVENTION

The present invention relates generally to board games. More specifically, the present invention related to rules and apparatus for playing a board game for multiple players wherein the object of the game is for players to battle one another using tile-like game pieces and dice.

BACKGROUND OF THE INVENTION

Examples of board games using tile-like game pieces and/or battle-based games are disclosed in U.S. Pat. Nos. 2,703,713, 4,200,293, 4,411,433, 4,674,753, 4,676,510, 5,150,908, 5,570,887, 5,607,159, 5,791,652, 5,803,461, 5,810,666, 6,070,871, 6,170,825, 6,257,576, and 6,305,688, the disclosures of which are incorporated by reference in their entirety for all purposes. Another example of a tile-based game is dominoes, in all its many forms.

SUMMARY OF THE INVENTION

The present invention provides rules and apparatus for playing a board game. This board game uses tile-like game pieces that may be arranged in a side-by-side relationship. Numerical printed indicia or other indicators on the face of the tile, and preferably along the outer periphery of a face of the tile, may be used for comparison against similar indicators on adjacent tiles. Preferably, one or more dice are used to determine which of the indicators is to be compared to an adjacent indicator.

In the preferred embodiment, the indicia used in the game are based on the characters, items, and monsters appearing in the Yu-Gi-Oh!™ television program.

The advantages of the present invention will be understood more readily after consideration of the drawings and the Detailed Description.

DETAILED DESCRIPTION OF THE INVENTION

Figure 1:
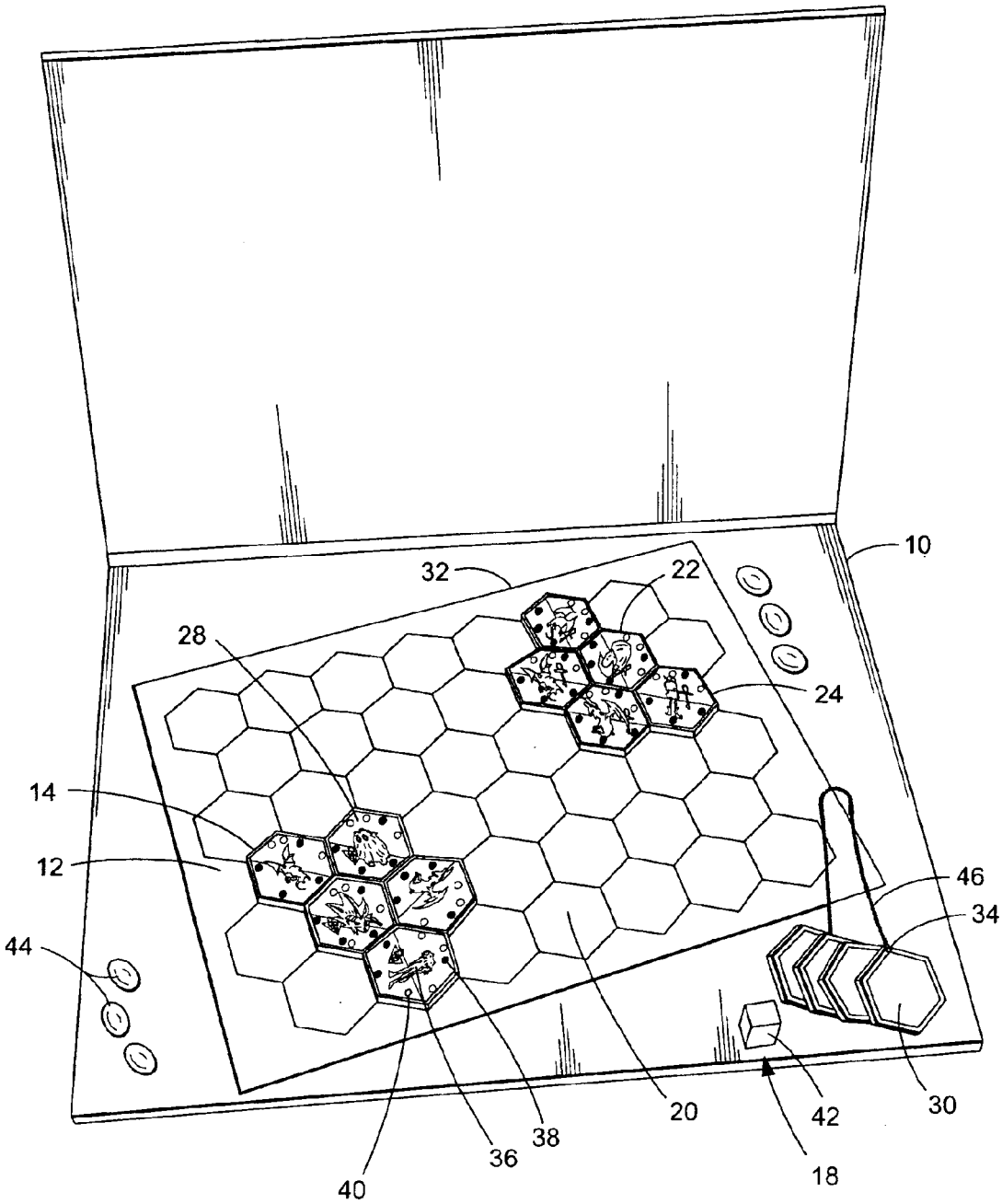
FIG. 1 depicts one embodiment of a game board and components suitable for use with the game of the present invention.

Game 10 typically includes a game board or mat 12, a plurality of moveable pieces, typically in the form of tiles 14, chasers 16, and a die 18.

Game board 12 is divided on one side into predefined spaces, namely geometric spaces 20 which are typically hexagons. The back of game board 12 may feature pictures and symbols for all tiles 14 in a periodic-style chart.

Referring to FIG. 1, the preferred moveable tiles 14 are also hexagonal in shape so that they fit approximately within at least some of the spaces 20 of game board 12. Tiles 14 include character tiles 22, monster tiles 24, and trap tiles 26. Character tiles 22 represent a players' power. When a character tile 22 is defeated, that player loses game 10. Monster tiles 24 are used to attack opposing character tiles 22 and monster tiles 24 or to defend a player's character tiles 22. Trap tiles 26 add effects that aid a player or hinder a player's opponent.

Tiles 14 have an upper face 28 and a relief-sculpted back 30. Tiles 14 are shaped to define a plurality of predefined flat sides 32 defining an outer periphery that surround upper face 28. At least one of tiles 14 typically includes a hole 34 for receiving a string-like holder. Upper face 28 has a label printed with plural indicia divided into identifiable groups of indicia, which are placed adjacent to each of sides 32 so that an indicia is associated with each of the sides 32. These indicia may show a character 36, a color 38, and an indicator 40, which are used to indicate the type of tile 14 and the relative power of that tile 14. Indicator 40 may be a number and may be printed over a background of color 38. The combination of these indicia forms strike values that determine the outcome of a battle when a player attacks opposing tiles 14, as will be discussed in the description of dueling.

Figure 2:
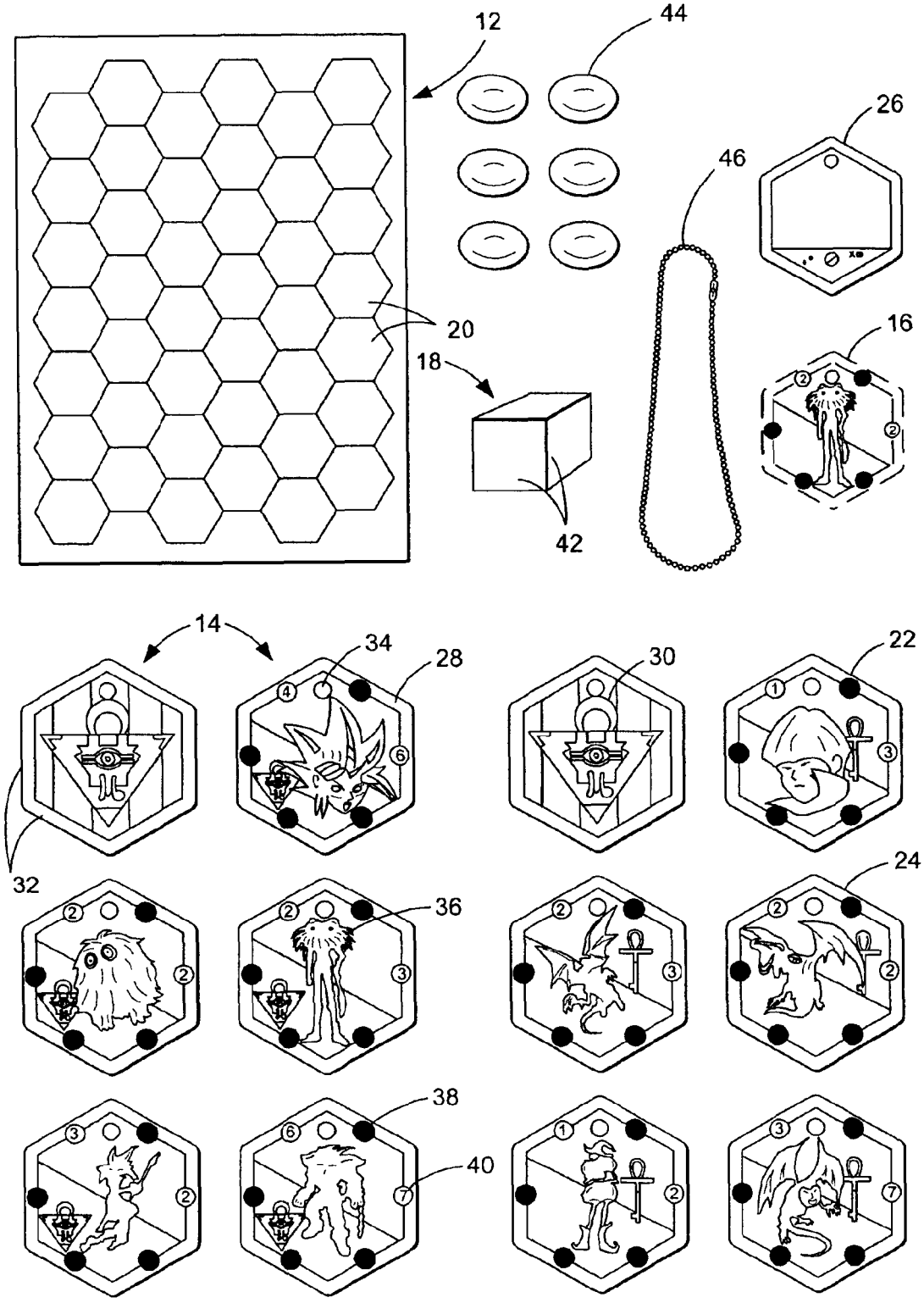
FIG. 2 depicts one embodiment of various game components suitable for use with the game of the present invention.

One embodiment of the game will include ten hexagonal tiles 14, one of which has indicia representing a certain character, such as "Yugi," and another of which has indicia representing a certain character, such as "Seto." The eight other tiles 14 may include indicia representing various monsters, as shown in FIG. 2. Other number of tiles 14 may also be used.

Die 18 is shaped to define a plurality of predefined faces, which are printed with separate indicia on at least two of the faces. Each of these indicia is associated with at least one of the identifiable groups of indicia shown on upper face 28 of tiles 14. Die 18 is typically used to match indicia on die 18 to that of moveable tiles 14. Indicia on die 18 may differ by color 38 or numeric indicator 40, which typically match those on upper face 28.

Game 10 would also typically include a rule book, which is typically 4"×5", flat glass marbles referred to as star gems 44, and ball chains 46 for passing through hole 34. Chains 46 are typically eight inches in length, although other embodiments may be available.

Tiles 14 may contain several features that encourage players to collect different combinations of tiles 14 and eventually the entire issue. Alliances are formed by tiles 14 that belong together in terms of a story (i.e., Yugi and his monsters) and can draw additional powers from each other. Chasers 16 are indicated by a special foil label, these tiles will be character tiles 22 and more powerful monster tiles 24 that will be available in extremely limited numbers. Each separate issue of tiles 14 may also have a different relief-sculpted back 30. The first series might have a millennium puzzle on its back 30, with the following issues having the rest of the millennium objects. Each tile 14 also typically has a small hole 34 that allows kids to link them together on a small chain 46 so they can be easily carried or displayed.

Most labels on upper face 28 of tiles 14 are five color; chasers 16 are five color on foil. All character and monster tiles may be of the same color, such as gold. Traps may be of a different color, such as silver. Tiles should have a little weight, and sound like coins when dropped on a table. All tiles may have a label showing the character/monster, their attack values listed on each side 32, and their alliances.

The following table lists a possible set of material and dimensions.

| | | Qty. | Material | Size | Color |
|---|---|---|---|---|---|
| | Purchased Part | 1 | | | |
| 1 | Die | 1 | HIS | 5/8 × 5/8 | White |
| 2 | Ball chain w/ fastener | 2 | metal | 8" length | Silver |
| 3 | Flat Marbles | 6 | Glass | .5" × .187" | Black Metallic |
| | Molded Parts | | | | |
| 1 | Hexes | 10 | Zamak | .75"R × .125 | Gold |
| | Printed Material | | | | |
| 1 | Play Mat | 1 | Glossy paper | 10" × 14" | 5 Color-Printing, 2 Sided |
| 2 | Rule Book | 1 | Glossy Paper | 4" × 5" (closed) 10 pgs | 5 Color-Printing, 2 Sided |
| 3 | Labels | 10 | Mylar | 1.125" × 1.28" | 5 Color-Printing |
| | Paint/Spray Op | | | | |
| 1 | Die Tampo print | 6 | | .375" × .375" | Black |

The present invention is a game played by at least two players. The rules of the game are described in the following paragraphs.

The game may be sold in a Starter pack as shown in FIG. 1, which allows players to become acquainted with the game and teaches the two basic levels of the game. The entire three-level game is not available until players buy a Booster pack that may include spells and traps not available in the starter pack.

The object of the game is to reach and beat an opponent's character tile 22 with a monster tile 24.

Basic game play begins by players flipping a token to see who picks first, and then the winner picking a character tile 22. Players line up all monster tiles 24, face-down and in a random order, and pick one at a time until each player has at least four monsters.

Players place their character tiles 22 at the marked locations on game board 12 and place their monster tiles 24 face-up in a circle around their character tile 22.

Figure 3:
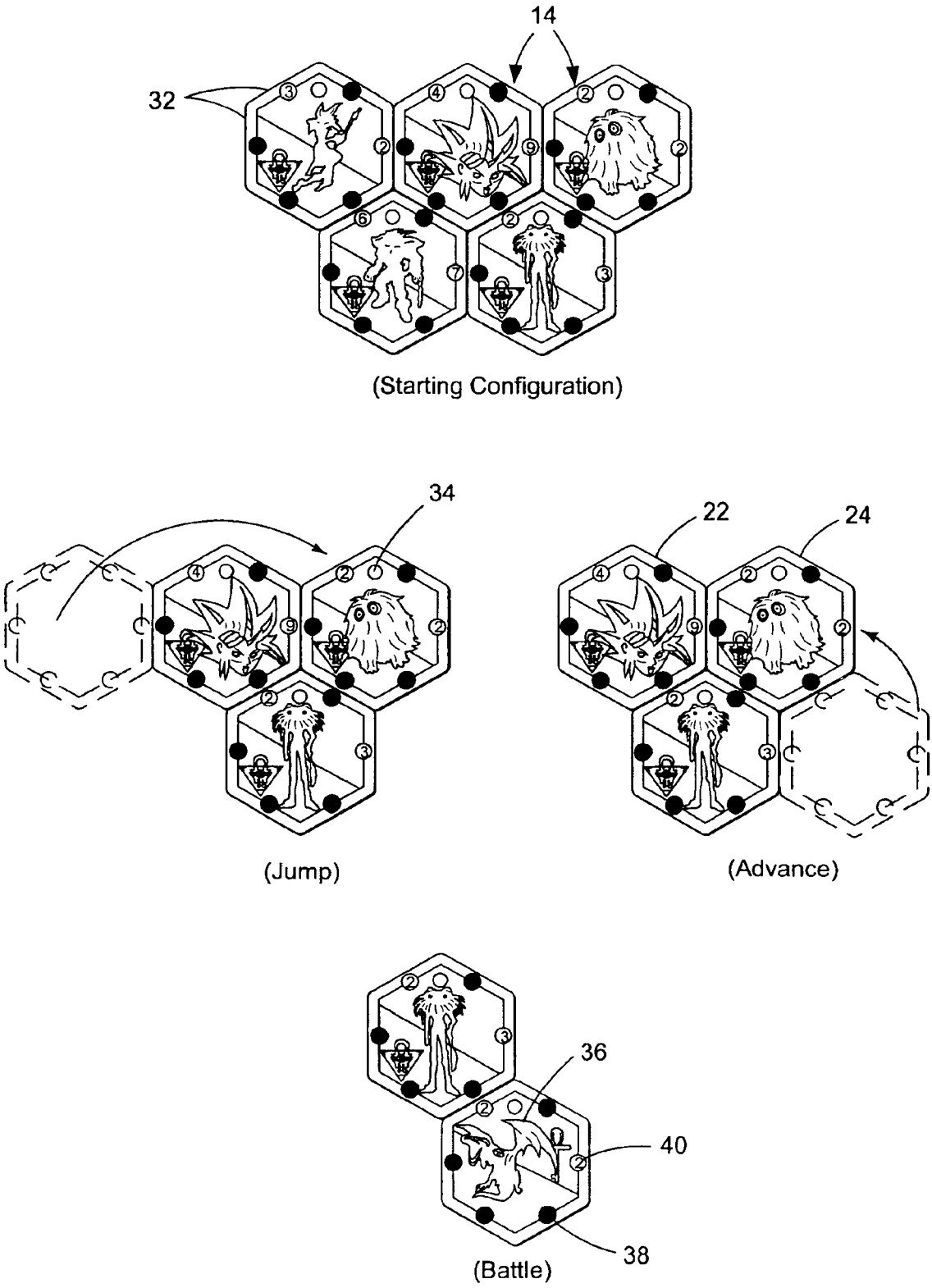
FIG. 3 depicts four possible layouts of tiles of one embodiment of the game of the present invention.

The player who picked last goes first. Monster tiles 24 may either advance one space 20 per turn or may jump one or more of their own pieces to move more quickly, as long as the move is to an unoccupied space, as shown in FIG. 3. Jumping requires that monster tile 24 is touching another tile 14 under that player's control. Pieces must always touch at least one other tile 14. Any tile 14 left on its own is removed from the board.

During each turn a player must either move his or her character tile 22 or monster tile 24. If a player is unable to move either then that player loses game 10.

When any two opposing pieces land in face-to-face contact, the move ends and a duel begins. The player who moved a tile 14 into contact is the attacker. In the basic form of the game dueling begins with the attacker. Each player chooses one of the groups of indicia on his or her tile 14 by rolling die 18. The player then matches that indicia, typically color 38, to one of the identifiable groups of indicia on tile 14, such as the colored strike value on their tile 14, as shown by indicator 40. The values are compared and the highest number wins. If the values are the same then players re-roll until the tie is broken and one player is a winner. Losing monster tiles 24 are removed from game board 12 and placed in that player's discard pile. If a character tile 22 is defeated then game 10 ends, regardless of remaining monster tiles 24. Dueling becomes more complicated in the intermediate and advanced games and involves more strategy, as character tiles 22 and trap tiles 26 add further variables to the existing format.

If an attacking monster tile 24 ever comes into contact with two or more opposing tiles 14 at the same time, the attacking monster tile 24 must battle all enemy tiles 14 it touches. The attacking player is allowed to choose the order of attacks. If the attacker comes into contact with a character tile 22 and monster tile 24 at the same time, the attacking player need only defeat the character tile 22 in order to win the game.

Play continues until one player breaks through his or her opponent's defenses and defeats the opposing player's character tile 22, thereby winning the game.

In one embodiment of the beginner game, every character tile 22 receives an automatic bonus of two, which is added to the rolled strike value during duels.

The Collector's Game is intended to be a more advanced version of the Beginner's Game, trap tiles 26 are therefore added to the game components to add new levels of strategy. When playing the more advanced version, players no longer begin the game by drawing character tiles 22 and monster tiles 24. Instead each player brings his or her own tiles 14. Each player must have one character tile 22 and the same number of monster tiles 24 and trap tiles 26 as his or her opponent. Typically, players may not have more than two identical monster tiles 24 or trap tiles 26. The trap tiles 26 are placed face-down in front of the respective player although players may look at their own traps throughout the game.

The glass beads 44 included in the game are referred to as star gems. Star gems 44 are used to trigger play of trap tiles 26. Players gain star gems 44 by winning duels. Every time a player defeats an opposing monster tile 24, the winning player typically takes one star gem 44 from a bank of star gems. The collected star gems 44 are placed in a pile behind that players' row of trap tiles 26, which is referred to as the trigger pool. Gems 44 in a players' trigger pool are then used to trigger traps, most of which cost 1, 2, or 3 star gems 44. There is no limit to the number of gems 44 that can be used in a game. If more are needed, players may supplement the game with additional objects, such as pennies.

The series of dots in the lower left corner of trap tiles 26 is the number of gems 44 a player must spend to trigger the trap. The indicators 40 in the lower right corner describe the power of trap tile 26 and its function. The background color of trap tile 26 identifies the type of trap and the duration of its effect. For example, a yellow background on a trap tiles' label indicates that it is a flash trap. This type of trap typically lasts only during the turn it is triggered and is placed in a discard pile at the end of the turn. A flash trap can be triggered at any time, regardless of whose turn it is. Another embodiment is that of a blue background to indicate a binding trap. The affect of this trap is typically permanent and remains in play until the end of the game, or until it is destroyed. A player may only play a binding trap during his or her turn. To trigger a trap, a player flips over the trap tile 26 and pays the appropriate number of star gems 44 from his or her trigger pool to the bank. Players may trigger as many traps as desired, provided that player has enough star gems 44.

If multiple traps are triggered in one turn, they take effect one after another. The traps should be resolved in that same order, as some traps may undo the effect of those played before them. Once star gems are spent to trigger a trap they may not be recovered, even if an opponent cancels the trap with another trap. Any permanent trap that a player places may be used by that player in jumping or forming of a pod. Whenever a trap has been used or destroyed, it is placed in a discard pile.

One embodiment of the game includes numerous types of trap tiles 26, as follows.

DISARM—A flash trap that requires 1 star gem. Destroys one triggered trap tile, canceling its effect. Place the destroyed tile in discard.

MYSTIC BARRIER—A binding trap that requires 1 star gem. Place this tile on any empty space in the Arena as a permanent wall. Mystic Barrier is considered a friendly tile to the player who triggered it. That player's tiles may jump over the Barrier. Opposing tiles will have to go around it.

SYMBIOSIS—A flash trap that requires 1 star gem. Place this tile on top of any monster you wish to target—for the remainder of that turn, the targeted monster may use the greatest Strike Value of any friendly monster with which it is in face-to-face contact.

SUN DAGGER—A flash trap that requires 1 star gem. Place this tile on top of any monster you wish to target—for the remainder of that turn, add 3 to the targeted monster's Strike Value.

POWER TRAP—A flash trap that requires 1 star gem. When triggered, steal one Star Gem from your opponent's Trigger Pool and place it in your pool.

SOUL CLAMP—A binding trap that requires 2 star gems. Place this tile on top of the monster you wish to target—for the remainder of the game or until the trap is disarmed, the targeted monster cannot move, attack or be attacked. It becomes a friendly wall to the player who triggered Soul Clamp. That player can jump over the Clamped monster. The opposing player must go around it.

GENESIS—A binding trap that requires 2 star gems. Return any monster from your discard pile to the Arena. The returned tile must be placed within 2 spaces of its character tile.

DIVINE CHAIN—A binding trap that requires 2 star gems. Place this tile on top of the monster you wish to target—for the next 3 turns the targeted monster cannot move or attack. It may defend itself if attacked, but loses its Element Bonus and Pod Bonus, if applicable.

SANDSTORM—A flash trap that requires 2 star gems. Destroys all of your opponent's triggered trap tiles. Place the destroyed tiles in discard.

EARTH FIST—A flash trap that requires 2 star gems. Place this tile on top of the monster tile you wish to target—for the remainder of that turn, add 7 to the targeted monster's Strike Value.

NOVA BURST—A binding trap that requires 3 star gems. Place this tile beneath the monster tile you wish to target—for the remainder of the game or until the trap is disarmed, add 3 to the targeted monster's Strike Value.

ZOMBIFY—A flash trap that requires 3 star gems. Place this tile on top of any opposing monster you wish to target—for the remainder of the turn you control the targeted monster. It becomes a friendly monster to the player who cast Zombify.

The turn sequence of the Collector's Game mirrors that of the Beginner Game, except for additional dueling steps. Once both players have rolled die 18 to determine their strike values, both players add an element bonus to their strike values, which is identified by a second indicia from the group of indicia on tiles 14, and may additionally include a pod bonus based on tile 14 proximity.

In one embodiment, the different background colors 38 of every monster tile 24 represent elements, such as green for earth, blue for water, yellow for wind, red for fire, purple for darkness, and white for light. A monster obtains additional power from its element to increase its strike value. Character tiles 22 determine the amount of the additional power. During a duel, the color 38 of the monster's element is matched to the same-colored number 40 on its character tile 22, that value is then added to the strike value.

Whenever two or more tiles 14 under the control of the same player are placed in face-to-face contact with each other, they form a pod. When dueling, any tile 14 in a pod gains an additional one point to its strike value, regardless of how many tiles 14 make up the pod or how many times the pod has attacked or been attacked.

Although character tiles 22 may be used to form a pod, they do not receive a pod bonus themselves since character tiles 22 receive a character strike bonus instead. The number found on the upper face 28 of the tile is the character strike bonus, which is added to that character's strike value during a duel.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such thereof, elements neither requiring nor excluding two or more such elements.

Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

What is claimed is:

1. A method of simulated battle between movable game pieces comprising the steps of:

providing a first movable game piece and a second moveable game piece;

identifying each of the first movable game piece and the second moveable game piece with indicia representing a player alignment, and plural indicia divided into identifiable groups of indicia;

providing a die shaped to define a plurality of predefined faces, and printed with a separate indicia on at least two of the predefined faces, each separate indicia of the die associated with at least one of the identifiable groups of indicia;

choosing one of the identifiable groups of indicia on the first moveable game piece by rolling the die to obtain a separate indicia that indicates one of the identifiable groups of indicia by matching one indicia of the one of the identifiable groups of indicia;

determining a first battle value based on another indicia of the one of the identifiable groups of indicia indicated on the first moveable game piece;

choosing one of the identifiable groups of indicia on the second moveable game piece by rolling the die to obtain a separate indicia that indicates one of the identifiable groups of indicia by matching one indicia of the one of the identifiable groups of indicia;

determining a second battle value based on another indicia of the one of the identifiable groups of indicia indicated on the second moveable game piece; and comparing the first battle value to the second battle value to determine a winner of the battle.

2. The method according to claim 1, wherein the one indicia of the one of the identifiable groups of indicia is based on color.

3. The method according to claim 2, wherein the separate indicia on the die are based on color.

4. The method according to claim 3, wherein the another indicia of the one of the identifiable groups of indicia is a number.

5. The method according to claim 2, wherein the another indicia of the one of the identifiable groups of indicia is a number.

6. The method according to claim 1, further comprising the steps of:

providing an outcome-determinative movable piece;

identifying the outcome-determinative movable piece indicia representing a player alignment, and with plural indicia divided into identifiable groups of indicia;

further identifying the outcome-determinative movable piece with unique identification to show visually a difference of the outcome-determinative movable piece from the first movable game piece and the second movable game piece;

choosing a second one of the identifiable groups of indicia on the first moveable game piece by rolling the die to obtain a separate indicia that indicates one of the identifiable groups of indicia by matching one indicia of the one of the identifiable groups of indicia;

determining a third battle value based on another indicia of the second one of the identifiable groups of indicia indicated on the first moveable game piece;

choosing one of the identifiable groups of indicia on the outcome-determinative moveable game piece by rolling the die to obtain a separate indicia that indicates one of the identifiable groups of indicia by matching one indicia of the one of the identifiable groups of indicia;

determining a fourth battle value based on another indicia of the one of the identifiable groups of indicia indicated on the outcome-determinative moveable game piece; and determining a winner of a game if the third battle value beats the fourth battle value.

7. The method according to claim 6, wherein the second one of the identifiable groups of indicia indicated on the first moveable game piece is the same as the one of the identifiable groups of indicia indicated on the first moveable game piece, if so indicated by rolling the die.

* * * * *